United States Patent [19]

Anderson et al.

[11] 4,056,901

[45] Nov. 8, 1977

[54] DRESSER AND GRINDING MACHINE THEREFOR

[75] Inventors: Marvin R. Anderson, Grosse Pointe Shores; Harald N. Jungesjo, Rochester, both of Mich.

[73] Assignee: Anderson-Cook, Inc., Fraser, Mich.

[21] Appl. No.: 662,076

[22] Filed: Feb. 27, 1976

Related U.S. Application Data

[62] Division of Ser. No. 559,945, March 19, 1975, Pat. No. 4,008,702.

[51] Int. Cl.[2] ..... B24B 49/18

[52] U.S. Cl. ..... 51/165.87; 125/11 PH

[58] Field of Search ..... 125/11 R, 11 PH, 11 TP; 51/165 R, 165.87, 165.88

[56] References Cited

U.S. PATENT DOCUMENTS

| | | | |
|---|---|---|---|
| 1,865,067 | 6/1932 | Warsaw | 51/165.87 |
| 2,565,687 | 8/1951 | Hoier | 125/11 PH |
| 2,602,437 | 7/1952 | Tanered | 125/11 PH |
| 2,720,062 | 10/1955 | Fouquet | 51/165.87 |
| 2,900,974 | 8/1959 | Hill | 125/11 PH |
| 3,137,103 | 6/1964 | Stade | 51/165.87 |
| 3,640,024 | 2/1972 | Stahn | 51/165.87 |
| 3,815,568 | 6/1974 | Gerner | 125/11 TP |

*Primary Examiner*—Harold D. Whitehead

*Attorney, Agent, or Firm*—Reising, Ethington, Barnard, Perry and Brooks

[57] ABSTRACT

A grinding machine and dresser therefor for dressing a grinding wheel of the machine to grind a crooked configuration in a workpiece. The dresser includes a holder for a template having the cutting profile of the grinding wheel as well as a holder for a cutting tool that dresses the wheel. The tool holder is mounted for movement with a template follower in an antifriction manner so that the cutting tool dresses the grinding wheel with the cutting profile. Cutting profiles for grinding precise toothed configurations are possible with the dresser. A carriage of the machine on which the dresser is mounted is slidably movable with respect to a base of the machine by axial movement of a dual threaded drive screw having right and left-hand threaded portions spaced axially along its length. First and second nuts respectively fixed on the base and the dresser each receive one threaded portion of the drive screw so its rotation moves the dresser relative to the carriage in the same direction and the same distance the carriage is moved relative to the base. The relative movement of the dresser with respect to the carriage causes a dressing of the wheel in a manner that maintains the same cutting depth of the workpiece before and after dressing. A hydraulic actuated pawl and ratchet power unit rotates the drive screw a controlled amount to index the carriage and dresser for a dress cycle. An electric screw brake is actuable to prevent the drive screw rotation and an electric nut brake that holds the first nut against rotation on the base during the dress index is then released to permit manual or power driven rotation thereof so as to drive the screw in a vertical direction without rotation and thereby raise or lower the carriage without the relative movement of the dresser.

23 Claims, 6 Drawing Figures

DRESSER AND GRINDING MACHINE THEREFOR

This is a division of application Ser. No. 559,945, filed Mar. 19, 1975, and now U.S. Pat. No. 4,008,702, issued Feb. 22, 1977.

BACKGROUND OF THE INVENTION

1. Field of the Invention

This invention relates to a grinding machine and dresser therefor for dressing a rotatable grinding wheel of the machine with a cutting profile that grinds a crooked configuration in a workpiece.

2. Description of the Prior Art

Grinding machines include rotatable grinding wheels that are formed from abrasive particles secured to each other by a bonding agent. As the wheel is rotated, each abrasive particle that engages the workpiece to be ground acts as a miniature cutting tool with irregular inefficient cutting angles, producing extremely small, highly deformed chips. Because of the small size of cut and the small chips, the surface finish is good and precise tolerances can be maintained. After being subjected to various amounts of use, grinding wheels wear as the abrasive particles become unbonded at the cutting profile of the wheel which engages the workpiece. To regain the precise tolerances with a used wheel, dressers are utilized with grinding wheels to dress the cutting profile to its original configuration.

When grinding wheels have a cutting profile for grinding a crooked configuration having straight line bends and/or arcuately curved portions, the dressers utilize pointed cutting tools to dress the wheel. The cutting tool normally has a diamond at its point which is engaged with the rotating wheel to provide the dressing. The cutting tool is mounted by a holder which is moved in accordance with the movement of a follower that follows a template mounted on the dresser. The template normally has the profile of the ground workpiece and faces the cutting wheel in an opposed relationship so that the template profile is the reverse image of the grinding wheel cutting profile which is the reverse image of the configuration ground into the workpiece. By way of example, if the workpiece is to be ground with a toothed configuration, the template normally has a toothed profile like that to be ground into the workpiece and is mounted on the dresser in an opposed relationship with respect to the cutting profile of the grinding wheel. Therefore, when the follower is engaged with the tips of the template teeth, the cutting tool is dressing the wheel in the valleys between the teeth of the cutting profile of the wheel. Likewise, the follower is engaged with the valleys between the template teeth while the cutting tool is dressing the tips of the cutting profile on the wheel. When there is a particularly steep angle to the toothed configuration to be ground, the follower is subjected to lateral forces as it is engaged with the valleys between the template teeth. The cutting tool is then being moved in accordance with the follower movement to dress the tips of the teeth on the cutting profile of the wheel, these tips being the wheel portions that grind the valleys between the teeth ground into the workpiece. The lateral forces can cause problems in maintaining the desired tolerance in the toothed configuration ground into the workpiece.

A grinding wheel must be moved in relation to the workpiece after being dressed in order to maintain the same depth of cut before and after dressing. The movement of the wheel must be equal to the change in its radius during dressing. Usually, the dresser is mounted on the opposite side of the wheel from the workpiece in a 180° relationship. Consequently, the dresser must be moved twice as far as the wheel in order to maintain the proper positioning of the wheel and the dresser so there is the same cutting depth in the workpiece before and after dressing. In the past, this movement of the wheel and dresser has been accomplished by a drive screw that has first and second threaded portions spaced axially along its length. One of the threaded portions has a pitch twice as great as the other and drives the dresser, while the other threaded portion of lesser pitch drives the grinding wheel. The rotation of the drive screw thus maintains the proper spaced relationship between the grinding wheel and the dresser since the greater pitch of the dresser screw portion moves it twice as far as the wheel for a given amount of screw rotation.

SUMMARY OF THE INVENTION

An object of the present invention is to provide a grinding machine dresser including a holder for a template with a crooked cutting profile of the associated grinding wheel so that a follower can follow the template and move a holder for a cutting tool having a cutting portion that dresses the wheel with the cutting profile.

Another object of the invention is to provide a method for dressing a rotatable grinding wheel by mounting a template having a crooked cutting profile to be dressed in the wheel and then moving a follower along the template along with a cutting tool so that the crooked cutting profile of the template is dressed into the wheel by the tool.

A further object of the invention is to provide a grinding machine and a dresser therefor wherein a rotatable drive screw has axially spaced right and left-hand threaded portions of the same pitch, with a first nut fixed on a base of the machine to receive one of the threaded portions so that screw rotation moves the screw axially to move a grinding wheel carriage with respect to the base, and with a second nut fixed to the dresser and receiving the other threaded portion of the screw so that the screw rotation moves the dresser with respect to the carriage in the same direction as the carriage moves with respect to the base in a manner that maintains the same cutting depth of the workpiece to be ground before and after dressing.

In carrying out the above objects, as well as other objects, a grinding machine and dresser therefor embodying the invention is used in accordance with the dressing method thereof to dress a grinding wheel of the machine for close tolerance grinding of workpieces with crooked configurations.

The grinding machine includes a base that mounts a grinding wheel carriage for vertical movement with respect to a workpiece below the wheel. The dresser is mounted on the carriage for vertical movement with respect thereto above the grinding wheel. A drive screw of the machine has right and left-hand threaded portions spaced axially along its length and is engaged with the carriage so axial screw movement raises or lowers the carriage. A first nut rotatably fixed with respect to the base by an electric nut brake receives one of the threaded portions so screw rotation during a dress cycle moves the screw and carriage downwardly with respect to the workpiece. A second nut receives the other threaded portion of the drive screw so that the screw rotation moves a cutting tool held by the dresser downwardly with respect to the carriage the same distance the carriage moves downwardly with respect to the workpiece. The relative movement of the dresser with respect to the carriage during the dress cycle maintains the grinding wheel in the proper location with respect to the workpiece for the same cutting depth before and after dressing.

A hydraulically actuated power unit rotates the drive screw a predetermined amount to perform the dress cycle. The power unit includes a hydraulically moved slide that carries a spring biased pawl which engages a ratchet wheel rotatably fixed to the shaft by a slide fit in order to rotate the shaft a predetermined amount. The slide engages an adjustable screw to control the degree of shaft rotation. The spring biasing of the pawl allows a return movement of the slide after the dress cycle. The ratchet wheel includes a sleeve that is permitted to rotate by an electric screw brake during the dress cycle but held thereby to prevent screw rotation when an operator desires to move the carriage vertically without movement of the dresser with respect to the carriage, such as during positioning of the wheel relative to a workpiece prior to commencing of the grinding and movement of the wheel away from the workpiece after completion of the grinding. The first nut is then released by the electric nut brake and rotated in either a power or manual mode to move the screw upwardly or downwardly in a nonrotational manner that raises or lowers the carriage without the relative movement of the dresser with respect to the carriage. The slide fit of the ratchet wheel to the screw permits the axial screw movement to take place while holding the screw against rotation.

The dresser includes a template holder for mounting a template having the crooked cutting profile to be dressed into the cutting wheel. The cutting profile of the template faces radially outward with respect to the grinding wheel and is engaged by a movable follower that is mounted in a fixed relationship with respect to a cutting tool holder for a cutting tool that has a cutting portion for dressing the wheel. By mounting the follower for movement over a template having the crooked cutting profile off the wheel, instead of the profile that is to be ground into the workpiece, accurate tolerances are maintained in the portions of the cutting wheel profiles that grind deepest into the workpiece. The tolerance is maintained due to the reduction of lateral forces on the follower and cutting tool while grinding the outermost portions of the cutting profile that grind the deepest portions of the workpiece, since these outermost portions of the cutting profile are dressed while the follower is in engagement with the tips of the crooked configuration on the template instead of engaged with the valleys between the tips of the template profile.

One use for the dresser is to dress a grinding wheel to grind precise tolerance toothed configurations in a workpiece. The cutting profile ground into the grinding wheel may have larger valleys between the teeth thereof than the teeth to be ground in the workpiece so that the tips of the teeth ground into the workpiece are formed from ground surfaces and pre-existing surfaces of the workpiece.

The follower and cutting tool holder are mounted on the dresser by a vertically extending linear antifriction bearing, and a horizontally extending linear antifriction bearing mounts the vertical one so that the follower and tool holder are mounted for movement in an antifriction manner.

BRIEF DESCRIPTION OF THE DRAWINGS

Other objects and attendant advantages of the present invention will be readily appreciated as the same become better understood by reference to the following detailed description when considered in connection with the accompanying drawings wherein.

DETAILED DESCRIPTION OF THE PREFERRED EMBODIMENT

Figure 1:
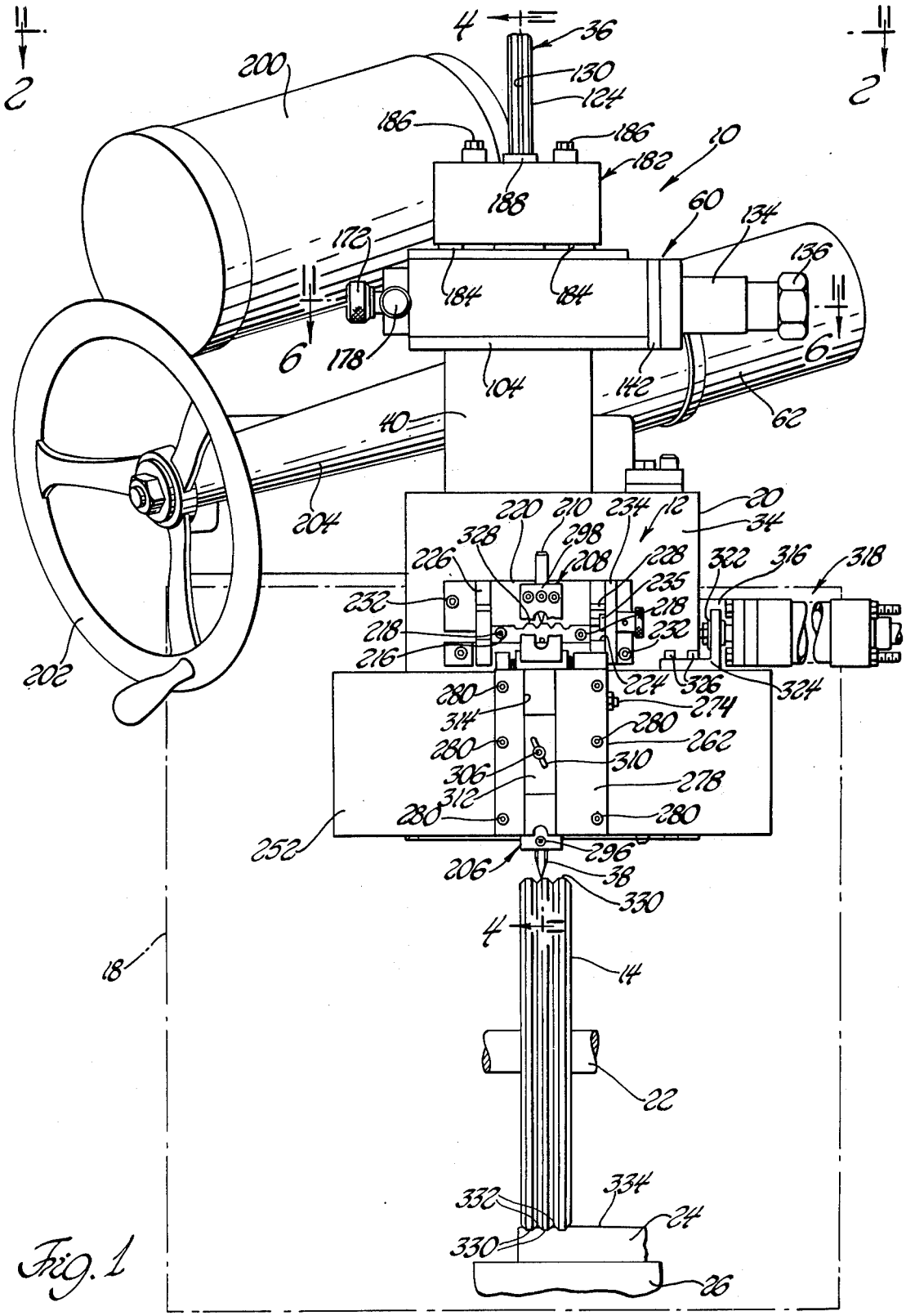
FIG. 1 is a front elevation view of a grinding machine and dresser therefor embodying the invention so as to be usable according to the method of dressing thereof.

Referring to FIG. 1, the invention is embodied by a grinding machine collectively indicated by reference numeral 10 and a dresser 12 for a rotatable grinding wheel 14 of the machine. A base 18 of the machine supports a carriage 20 for vertical movement in a manner that will be hereinafter described. The dresser 12 is mounted on the carriage 20 as is a shaft 22 that rotatably supports the grinding wheel. A workpiece 24 to be ground is supported below the grinding wheel in a 180° opposed relationship from the dresser and is mounted on a holder 26. The workpiece holder supports the workpiece for movement into and out of the plane of the drawing to engage and disengage the workpiece from the rotating grinding wheel.

Figure 4:
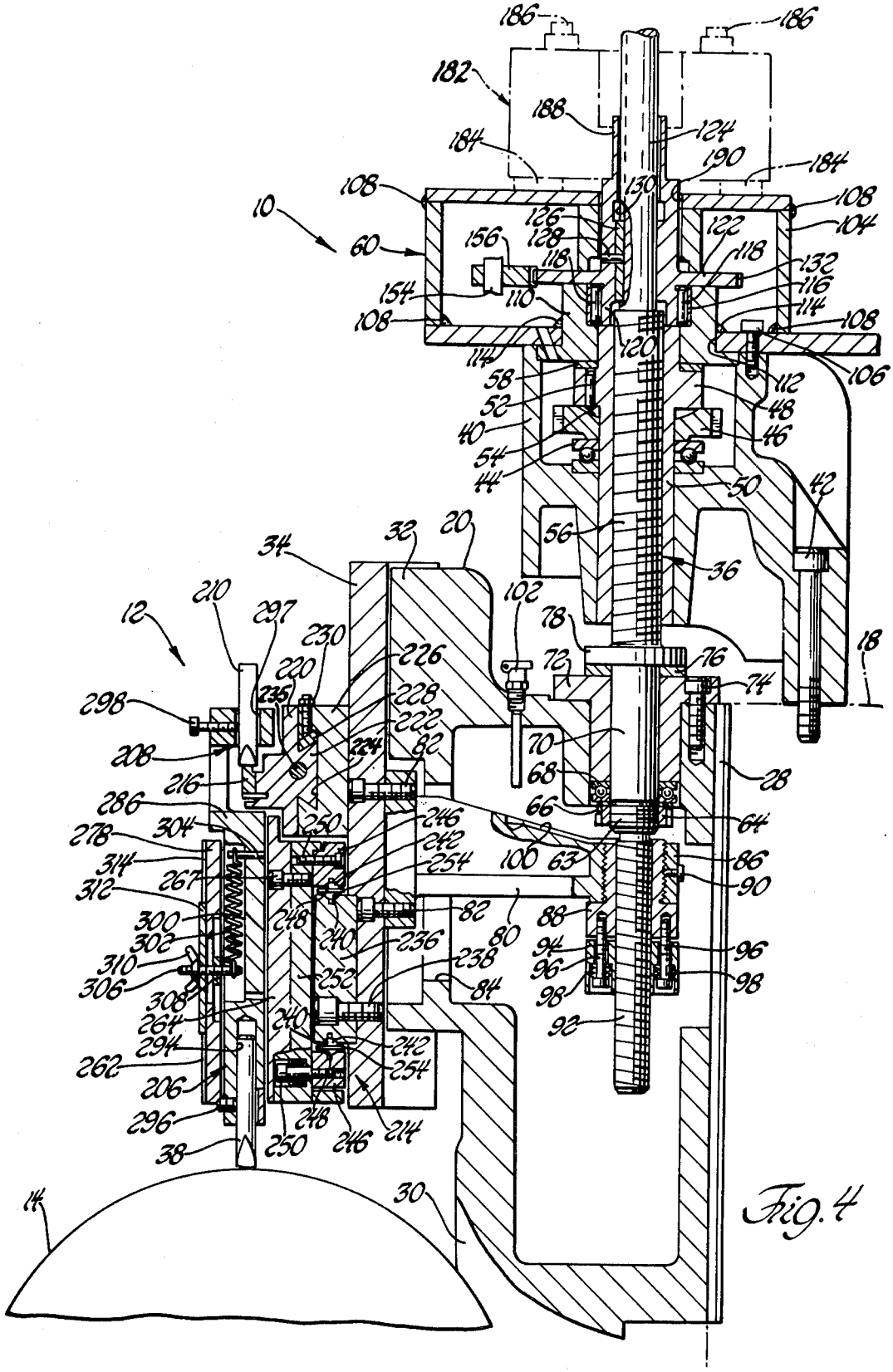
FIG. 4 is a sectional view of the grinding machine and dresser taken along line 4—4 of FIG. 1.

With additional reference to FIG. 4, the carriage 20 includes a vertical slide 28 that is mounted by the base 18 for upward and downward movement with respect to the workpiece. A pair of arms 30, only one shown, extend downwardly from the carriage to support the grinding wheel shaft 22 for rotational movement, and suitable driving means is utilized to rotate the shaft and the wheel. The carriage also includes a slide 32 that mounts a support plate 34 of the dresser for vertical movement with respect to the carriage. The vertical position of the carriage 20 with respect to the base 18 and the vertical position of the dresser 12 with respect to the carriage is controlled by a drive screw 36. The drive screw 36 is rotated, in a manner that will be hereinafter described, when dressing of the wheel is required to lower the carriage 20 with respect to the base 18 and to also lower the dresser 12 with respect to the carriage. The downward movement takes place while the workpiece is out of engagement with the grinding wheel and is of a magnitude so that the depth of cut before and after the dressing will remain the same. The dresser 12 moves down with respect to the carriage 20 the same distance as the carriage 20 moves down with respect to the base 18. Therefore, a pointed cutting tool 38 that dresses the wheel is moved downwardly twice as far as the wheel 14 is moved with respect to the workpiece to maintain the constant depth of cut before and after dressing.

The upper portion of drive screw 36, as seen in FIG. 4, is received within a housing 40 that is secured to the base 18 by a plurality of bolts 42, only one shown. An antifriction bearing 44 of the axial thrust type is mounted within the housing 40 encircling the drive screw and has a rotary member taking the form of a gear 46 supported on its upper side for rotational movement with respect to the housing. An annular support flange 48 of an elongated nut 50 is supported on the upper side of gear 46 and is rotatably fixed thereto by a pin 52 extending downwardly into a machined slot 54 in the gear. Nut 50 has an internal right-hand thread and receives a right-hand threaded portion 56 of the drive screw. Above the support flange 48 of nut 50, a thrust washer 58 encircles the nut and engages the lower side of a power unit 60 which is actuated during a dress cycle in a manner that will be subsequently described to rotate the drive screw 36 in a positive right-hand direction. During this screw rotation, an electric nut brake 62, FIG. 1, is energized to hold the gear 46 shown in FIG. 4 against rotational movement in a manner that will be described later. Consequently, the positive right-hand screw rotation caused by the power unit 60 during the dress cycle causes the drive screw 36 to move in a downward direction whose distance depends on the extent of the rotation and the pitch of the right-hand threaded portion 56.

The intermediate portion of drive screw 36 includes a threaded portion 63, FIG. 4, that receives a nut 64 which is held against rotation with respect to the screw by a washer key 66. An antifriction bearing 68 of the axial thrust type encircles an unthreaded portion 70 of the drive screw and is supported on the upper side of washer key 66. A flanged annular journal bearing 72 is secured to the carriage 20 by a plurality of bolts 74, only one shown, and also encircles the unthreaded portion 70 of the drive screw. The carriage 20 is thus suspended for vertical movement with the drive screw 36 along the axis of its vertical slide 28 so that the downward drive screw movement during the dress cycle lowers the carriage the same distance that the screw moves axially downward. Above the flange of bearing 72, a thrust washer 76 engages an annular flange 78 of the screw so that the carriage is positively positioned in both an upward and downward direction by the screw.

The support plate 34 on which the dresser is mounted has a flanged arm 80 secured to its inner side by bolts 82, FIG. 4. Arm 80 extends inwardly through an aperture 84 in the carriage and has an inner end 86 defining a vertical aperture which is threaded to receive a nut 88 that is threaded upwardly thereinto and secured in position by a set screw 90. Nut 88 is threaded internally in a left-hand manner and receives a left-hand threaded portion 92 of the drive screw 36. Another left-hand nut 94 also receives the threaded portion 92 of the screw and is secured to the lower side of nut 88 by headed bolts 96. Stacks of Belleville type washers 98 are arranged about bolts 96 between the bolt heads and the nut 94 to provide a resilient nut arrangement that positively positions the dresser arm 80 both upwardly and downwardly with respect to the drive screw 36 without any backlash in either direction upon screw rotation.

When the drive screw 36 is rotated in a positive right-hand direction and moved downwardly during a dress cycle by the fixed right-hand nut 50 to lower the carriage 20, the left-hand threading of the threaded screw portion 92 and the nuts 88 and 94 fixed to the dresser arm 80 moves the dresser arm in a downward direction so that the dresser 12 moves downwardly with respect to the carriage. The pitch of both the right and left-hand threaded portions 56 and 92 of the drive screw is the same so that the downward movement of the dresser with respect to the carriage 20 is the same as the downward movement of the carriage with respect to the machine base 18. Therefore, the dressing of the wheel 14 by the cutting tool 38 carried by the dresser changes the diameter of the wheel an appropriate amount so that grinding before and after dressing is with the same depth of cut in the workpiece.

The lower left-hand threaded portion 92 of the drive screw which drives the dresser 12 downwardly with respect to the carriage during the dress cycle is lubricated by an oil trough 100 machined into the dresser arm 80, as seen in FIG. 4. The oil trough is fed oil through a capped fitting 102 and is inclined downwardly toward the screw so that the oil flows under the influence of gravity.

With reference to FIG. 4, the power unit 60 for rotating drive screw 36 during the dress cycle includes a housing 104 secured to the upper side of the housing 40 by a plurality of bolts 106, only one shown. Housing 104 is formed from suitable plates secured to each other by welds 108. A flanged bearing support 110 of an annular configuration extends upwardly through an aperture 112 in the lower side of housing 104 and is secured with respect to the housing by welds 114. The bearing support 110 encircles the drive screw 36 and engages the thrust washer 58 at its lower side. The upper side of the bearing support receives a hardened sleeve 116 engaged by vertical rollers 118 disposed about the drive screw. The inner sides of the rollers 118 engage a lower annular flange 120 of a ratchet wheel 122. The ratchet wheel 122 is disposed about an unthreaded upper portion 124 of the drive screw 36 and has a vertically disposed key 126 secured thereto by a pin 128 so as to be slidably received within a vertical slot 130 of the upper drive screw portion 124. The ratchet wheel 122 is thus rotatably fixed with respect to the drive screw but permits axial upward and downward movement of the screw as the key 126 slides within the slot 130 in a manner that will be more fully hereinafter described.

Figure 6:
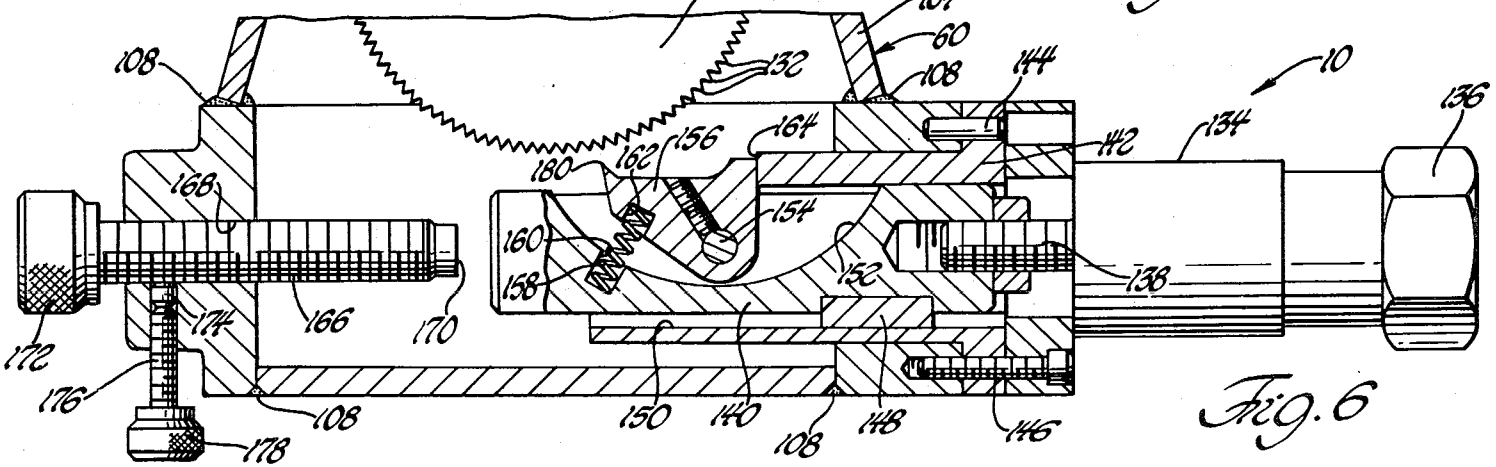
FIG. 6 is a sectional view taken along line 6—6 of FIG. 1.

With reference to FIG. 6, the ratchet wheel of power unit 60 includes ratchet teeth 132 disposed in a radially outwardly projecting manner. A hydraulic actuator 134 of the power unit has a nut fitting 136 that is threaded onto a suitable fluid pressure line to supply the actuator with pressurized fluid. An unshown piston within the actuator is secured to a threaded connecting rod 138 which is threaded onto a slide 140. An annular flanged support member 142 for the slide 140 is rotatably fixed with respect to the housing 104 by a pin 144 and is secured thereto by a plurality of bolts 146, only one shown, that also secure the actuator 134 to the power unit housing 104. The slide 140 includes a key 148 slidably received within an elongated slot 150 in the support member 142 so that the slide is movable to the left or right but will not rotate with respect to the support member. A machined groove 152 in the slide 140 receives a pin 154 that pivotally supports a pawl 156. A helical spring 158 has one end received within a hole 160 in the in the slide 140 and has another end received within a hole 162 in the pawl. The spring 158 biases pawl 156 clockwise about pin 154 and into engagement with a stop surface 164 on support member 142. An adjusting screw 166 is threaded into an aperture 168 in housing 104 and has a stop surface 170 on its right-hand end which engages the left-hand end of slide 140 to limit the hydraulically actuated movement of the slide to the left. The degree of this movement is adjustable by manual rotation of a knob 172 on the outer end of the screw. A brass plug 174 and a set screw 176 with a manually rotatable knob 178 hold the adjustment screw 176 in any adjusted position without damaging the threads of the adjustment screw.

During the dress cycle, the hydraulic actuator 134 is actuated to move its connecting rod 138 to the left so that the leftward movement of slide 140 causes the spring bias of pawl 156 to move it clockwise about pin 154. The pawl 156 has a tip 180 that engages the ratchet teeth during the slide movement to rotate the ratchet wheel in a clockwise positive right-hand direction. The degree of this rotation is controlled by the stop surface 170 of adjusting screw 166 and return movement of the slide is permitted due to the biasing of the pawl by spring 158. The pawl tip 180 stays to the left of a line through the center of pin 154 and the axis of rotation of ratchet wheel 122 so that the pawl always returns to the position shown in engagement with the stop surface 164. The ratchet wheel rotation caused by the pawl and slide movement rotates the drive screw 36 due to the slide fit of the ratchet wheel to the shaft by the key 126 and the slot 130 connection at the unthreaded upper portion 124 of the screw, as seen in FIG. 4.

Figure 2:
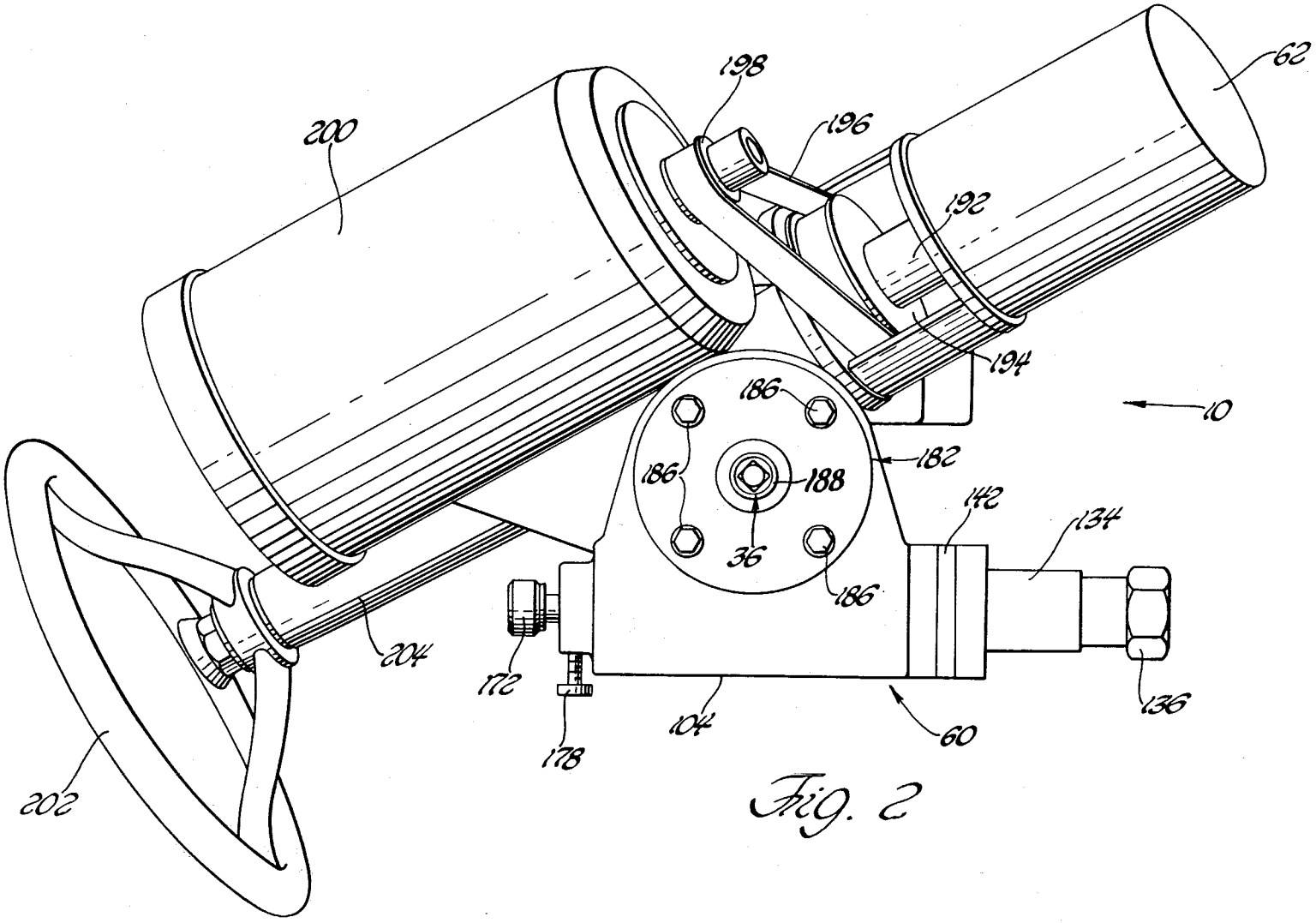
FIG. 2 is a top plan view taken along line 2—2 of FIG. 1.

With reference to FIGS. 1, 2 and 4, an electric screw brake 182 is mounted on top of the housing 104 of power unit 60 by a plurality of mounting blocks 184 and is secured thereto by circumferentially spaced bolts 186. The mounted brake 182 encircles the upper end of drive screw 36 and also receives an axial sleeve 188 of the ratchet wheel, see FIG. 4, that extends upwardly through the power unit housing 104 through an aperture 190. Screw brake 182 per se is of a conventional type wherein suitable electric circuitry energizes the brake to selectively operate on the sleeve 188 in a manner that holds the sleeve against rotational movement along with the drive screw 36 which is rotatably fixed to the sleeve. During the dress cycle when the ratchet wheel 122 is rotated to rotate the drive screw, brake 182 is de-energized and permits such rotation. However, when an operator desires to raise or lower the carriage 20 without movement of the dresser 12 with respect to the carriage, such as before and after grinding, he first energizes the drive screw brake 182 to hold the drive screw against rotation. The electric nut brake 62 previously mentioned, see FIG. 2, is normally energized during the dress cycle so that its shaft 192 is held against rotation and through a suitable unshown gear train holds the gear 46, FIG. 4, that is rotatably fixed to the nut 50. Electric nut brake 62 is de-energized to release the nut 50 when the operator desires to move the carriage without moving the dresser with respect to the carriage.

With reference to FIG. 2, the brake shaft 192 carries a belt sheave 194 that receives a continuous belt 196 driven by an output belt sheave 198 of an electric motor 200. A manually rotatable wheel 202 is supported by a housing 204 and is also rotatably fixed through the unshown gear train to the nut 50 shown in FIG. 4 by the gear 46. The motor 200 or the manual wheel 202 are used to drive the unshown gear train and rotate the gear 46 so that nut 50 is rotated while the screw brake 182 holds drive screw 36 against rotation. The effect of this nut rotation is to raise or lower the drive screw so the carriage 20 moves vertically without affecting the relative position of the dresser 12 with respect to the carriage.

Figure 3:
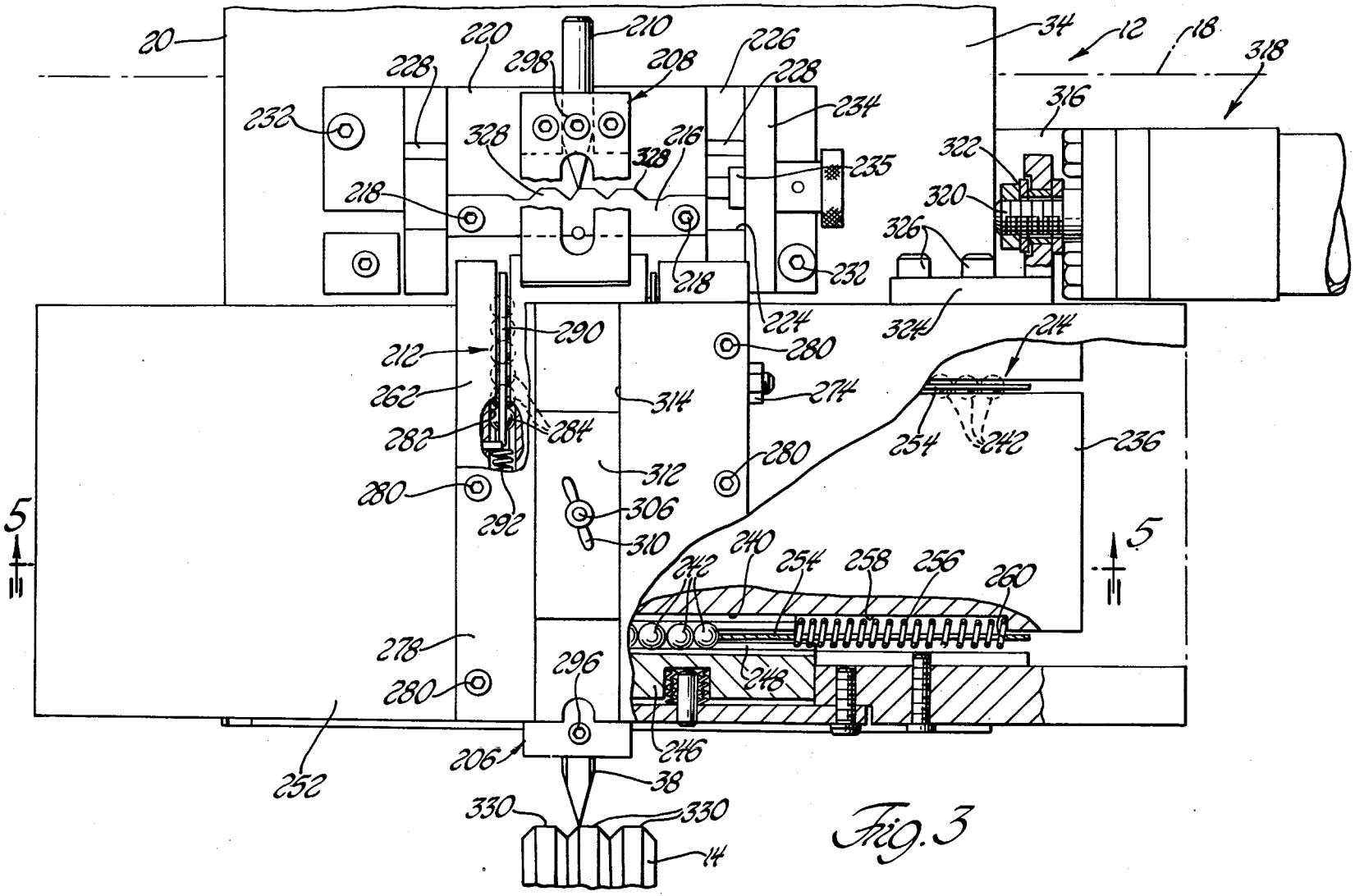
FIG. 3 is an enlarged view of a portion of FIG. 1 showing the dresser.

With reference to FIG. 3, a holder 206 for the pointed cutting tool 38 and a holder 208 for a pointed template follower 210 are fixedly mounted with respect to each other and supported for vertical and horizontal movement by a vertical linear antifriction bearing 212 and a horizontal linear antifriction bearing 214. The point of follower 210 is movable over a template 216 that is secured by bolts 218 to a holder member 220. The holder member 220, as seen by reference to FIG. 4, has a slide portion 222 received within a horizontally extending slideway groove 224 of a support member 226. A slide plate 228 is also received within the groove 224 and is engaged by a set screw 230 to locate the template holder member and the template carried thereby in the proper horizontal location with respect to the grinding wheel 14. The support member 226 for the template holder member is fixedly mounted on the dresser support plate 34 by bolts 232 shown in FIG. 3 and includes a flange 234 that supports a manually rotated screw 235 which is threaded into the holder member so that the screw rotation moves the holder member to the left or right as required to properly position the template.

With combined reference to FIGS. 3 and 4, the horizontally extending antifriction bearing 214 includes a rectangular bearing member 236 that is secured to the dresser support plate 34 by a plurality of bolts 238, only one shown. The upper and lower sides of bearing member 236 define horizontal grooves 240 which receive rows of bearing balls 242. A pair of upper and lower bearing members 246 define bearing grooves 248 that oppose the grooves 240 of bearing member 236 and also receive the balls 242. The upper and lower bearing members 246 are secured by a plurality of screws 250 to a bearing plate 252 which is thus mounted for horizontal movement in an antifriction manner. A pair of elongated ball cages 254 define apertures that receive the balls 242 to locate them within the bearing grooves 240 and 248. With reference to the lower cage 254 as shown in FIG. 3, a helical spring 256 is received within a notch 258 in the bearing member 236 and is also received within an aperture 260 within the ball cage so as to properly locate the cage with respect to its associated bearing members. The upper cage 254 is likewise positioned by a similar spring which is not shown in order to properly locate its associated bearing balls.

Figure 5:
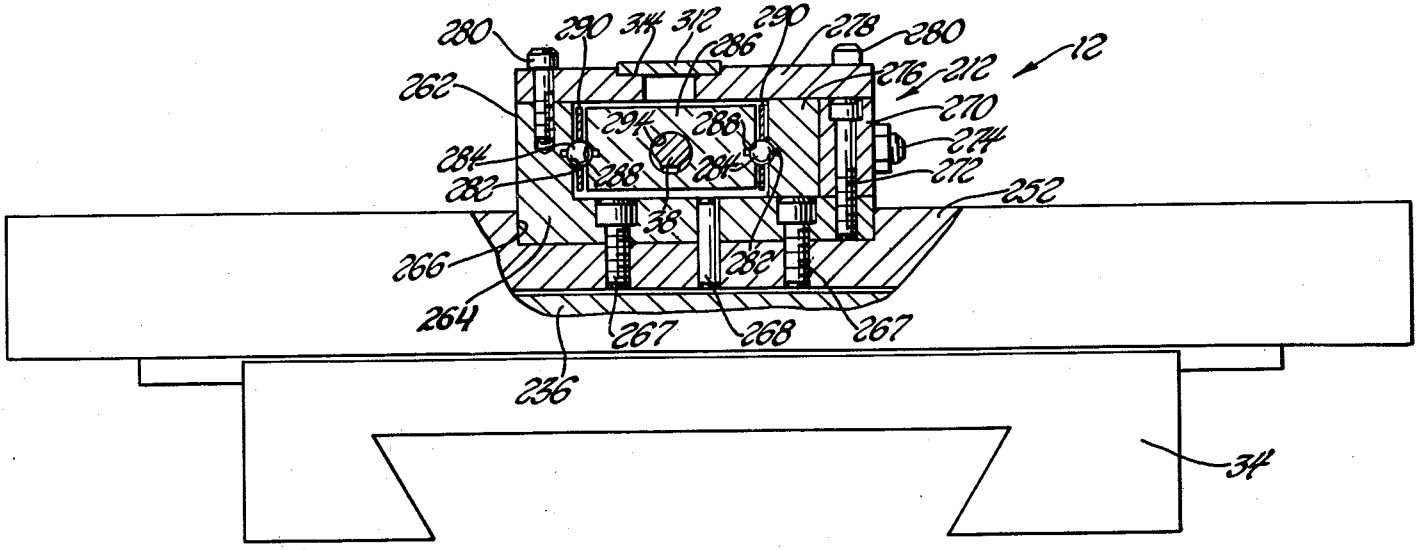
FIG. 5 is a partially sectioned view through the dresser taken along line 5—5 of FIG. 3.

With reference to FIGS. 3 and 5, the vertical antifriction bearing 212 includes a bearing housing 262 having an L-shaped bearing member 264 received within a notch 266 in the bearing plate 252 supported for horizontal movement by the horizontal antifriction bearing 214. A plurality of bolts 267 and a guide pin 268 secure the vertical bearing housing 262 to bearing plate 252. A plate 270 of the vertical bearing housing is secured to bearing member 264 by a plurality of bolts 272, only one shown. A plurality of nut and bolt arrangements 274, only one shown, secure a vertically extending bearing member 276 to the bearing plate 270. A cover plate 278 of housing 262 is secured to the L-shaped bearing member 264 and the bearing plate 270 by bolts 280. Bearing members 264 and 276 define vertical bearing grooves 282 that receive bearing balls 284 aligned in vertical rows. A bearing member 286 is located between the rows of bearing balls and defines vertical bearing grooves 288 which receive the balls in an opposed relationship to the grooves 282. Vertically extending cages 290 define openings that receive the bearing balls 284 and are positioned by helical springs 292, only one being shown in FIG. 3, to properly locate the cages in a manner similar to that described in connection with the horizontal antifriction bearing 214. Bearing member 286 is thus movable vertically in an antifriction manner.

With combined reference to FIGS. 3 and 4, the tool holder 206 for cutting tool 38 includes an upwardly extending aperture 294 defined in the bearing member 286 of the vertically extending antifriction bearing 212. The cutting tool is inserted upwardly into aperture 294 and secured by a set screw 296 so as to be maintained in position. The upper end of bearing member 286 includes an aperture 297, FIG. 4, which receives the downwardly pointing follower 210 that engages the upper side of template 216. A set screw 298 positions the follower 210 within the aperture 297. Intermediate its upper and lower ends, bearing member 286 defines a vertical groove 300 that receives a helical spring 302. The upper end of spring 302 is secured to a pin 304 press fitted into the bearing member 286, and the lower end of spring 302 is secured to a bolt 306. A slide 308 is movable upwardly and downwardly on the cover plate 278 of vertical bearing 212 so that a wing nut 310 received by the outer end of bolt 306 engages a slide 312 received within a vertical groove 314 of the cover plate. The wing nut 310 vertically locates the bolt 306 so as to control the tension of spring 302 which provides a downward bias to the vertically movable bearing member 286 of vertical antifriction bearing 212. Consequently, the follower 210 is constantly biased into engagement with the template 216 by the spring action. Likewise, the action of gravity on bearing member 286 cooperates with this spring bias to also engage the follower 210 with the template 216.

With reference to FIGS. 1 and 3, a plate 316 is secured to the dresser plate 34 in any suitable manner and supports a hydraulic actuator motor 318 of the piston and cylinder type. A threaded connecting rod 320 of motor 318 is secured by a nut and bushing arrangement 322 to one leg of an L-shaped bracket 324. The other leg of bracket 324 is secured by bolts 326 to the bearing plate 252 that is supported for horizontal movement in an antifriction manner by horizontal bearing 214. Motor 318 is actuated during a dress cycle to move the bearing plate 252 horizontally so that the follower 210 is moved over the upper surface of template 216. During the horizontal movement, the follower moves downwardly under its spring bias and the cooperable action of gravity as permitted by the template and moves upwardly by the camming action of the template in accordance with the template profile that faces radially outward with respect to grinding wheel 14.

The cutting tool 38 is moved upwardly and downwardly in a fixed relationship with the follower so that its lower pointed end dresses the grinding wheel 14 with the upwardly facing profile of template 216. Thus, the teeth 328 defined by template 216 dress a cutting profile on wheel 14 that includes teeth 330 of the same size and configuration as the template teeth. The tips of the grinding wheel teeth 330 are ground when the point of follower 210 is in engagement with the tips of template teeth 228. The tips of these grinding wheel teeth define the portions of the wheel that form valleys between a toothed configuration ground into a workpiece. Since these tips are ground when there is only a tip to tip engagement between the pointed follower and template teeth and between the pointed cutting tool and grinding wheel teeth, there are no substantial lateral forces to the right or the left that could cause problems in maintaining the desired tolerance. This is possible since the profile of template 216 is of the cutting wheel profile and not a profile of the ground workpiece. Furthermore, with reference to FIG. 1, the valleys between the teeth 330 of grinding wheel 14 are larger than the teeth 332 ground into workpiece 24. The upper surface 334 of workpiece 24 is located below the uppermost portions of the valleys between the grinding wheel teeth 330 and portions thereof are thus not ground by the wheel. Each tooth 332 ground into the workpiece is therefore defined by two ground surfaces and a preexisting surface of the workpiece. The deepest portions between the grinding wheel teeth 330 thus do not grind portions of the workpiece. These deepest portions of the grinding wheel cutting profile are, of course, dressed when the cutting tool 38 is located between the valleys of the wheel teeth 330 and when the pointed end of follower 210 is located in the valleys between the template teeth 328. At such times, lateral forces are present and could cause tolerance problems if they were dressing portions of the wheel that grind the workpiece. Each tooth 330 of the cutting wheel profile simultaneously grinds surfaces on two of the teeth 332 of the workpiece, and movement of the workpiece holder 26 to the left with the grinding wheel disengaged from the workpiece indexes the machine for grinding of additional teeth in the workpiece along its lateral length.

While a preferred embodiment has been described, those skilled in the art will recognize various alternative ways of practicing the invention as described by the following claims.

What is claimed is:

1. A grinding machine and dresser therefor comprising: a base; a carriage for rotatably supporting a grinding wheel so as to grind a workpiece, the carriage being mounted on the base for rectilinear movement with respect thereto; a dresser mounted for rectilinear movement with respect to the carriage in a direction parallel to the movement of the carriage on the base, the dresser including a tool holder for a cutting tool that dresses the wheel; an elongated drive screw having coaxial right and left-hand threaded portions of the same pitch spaced axially along the length thereof, the drive screw also having an intermediate portion between the right and left-hand threaded portions thereof; a bearing coupling the intermediate portion of the drive screw with the carriage to move the carriage along the base upon axial movement of the screw; a first nut fixed to the base and threadingly receiving one threaded portion of the screw so that screw rotation moves the screw axially to drive the carriage along the base; and a second nut fixed to the dresser and threadingly received by the other threaded portion of the drive screw on the opposite side of the bearing from the first nut so that the screw rotation moves the dresser relative to the carriage the same distance the carriage moves relative to the base and in the same direction, the dresser thereby moving twice as far as the carriage relative to the base for any given amount of screw rotation so a cutting tool held by the tooth holder of the dresser dresses the grinding wheel in a precise manner that maintains the same cutting depth of the workpiece before and after dressing.

2. A machine according to claim 1 wherein the dresser is mounted on the carriage.

3. A machine according to claim 1 wherein axial movement of the screw in opposite directions moves the carriage in opposite directions with respect to the base.

4. A machine according to claim 3 wherein the first nut is fixed to the base by a nut brake and is selectively released thereby for rotation to cooperate with a screw brake that selectively fixes the screw against rotation with respect to the base so as to move the screw axially in opposite directions to move the carriage in opposite directions without moving the dresser relative to the carriage.

5. A machine according to claim 4 wherein the first nut is manually or power rotated to axially drive the screw without screw rotation.

6. A machine according to claim 4 wherein the nut and screw brakes are electrically operated.

7. A machine according to claim 1 wherein the screw is rotated by a power operated unit to perform the dressing of the grinding wheel.

8. A machine according to claim 7 wherein the power operated unit is hydraulically operated.

9. A machine according to claim 7 wherein the power operated unit includes a ratchet wheel rotatably fixed to the screw and a pawl that is moved to rotate the ratchet wheel.

10. A machine according to claim 9 wherein the pawl movement is along a rectilinear path and is limited by an adjusting screw to control the degree of screw rotation.

11. A machine according to claim 10 wherein the pawl is pivotally supported by a slide that engages the adjusting screw, the pawl being spring biased to a ratchet wheel engaging position but movable against the bias to permit return movement of the slide after movement into engagement with the adjusting screw.

12. A machine according to claim 1 wherein the screw is oriented vertically and moves the carriage downwardly upon screw rotation.

13. A machine according to claim 12 wherein an antifriction bearing supports the carriage on the screw against downward movement.

14. A machine according to claim 13 wherein another antifriction bearing supports the first nut for rotational movement with respect to the base, the first nut being fixed by a nut brake during the screw rotation and being selectively released thereby for either manual or power driven rotation to cooperate with a screw brake that fixes the screw against rotation so as to drive the screw and carriage upwardly or downwardly without moving the dresser relative to the carriage.

15. A machine according to claim 14 wherein the first nut is located above the second nut.

16. A machine according to claim 15 wherein the nut brake is located above the first nut.

17. A machine according to claim 16 wherein the screw brake acts on a sleeve of a ratchet wheel that is rotatably fixed to the screw by a slide fit that slides during the axial nonrotational screw movement, the machine having a power unit with a pawl that rotates the ratchet wheel to drive the screw when the screw brake releases the screw for rotation and the nut brake holds the first nut against rotation.

18. A machine according to claim 1 wherein the first nut receives the right-hand threaded portion of the drive screw and the second nut receives the left-hand threaded portion thereof.

19. A grinding machine and dresser therefor comprising: a base; a carriage for rotatably supporting a grinding wheel so as to grind a workpiece, the carriage being mounted on the base for rectilinear movement with respect thereto; a dresser mounted on the carriage for rectilinear movement with respect to the carriage in a direction parallel to the movement of the carriage on the base, the dresser including a tool holder for a cutting tool that dresses the wheel; an elongated drive screw having coaxial right and left-hand threaded portions of the same pitch spaced axially along the length thereof, the drive screw also having an intermediate portion between the right and left-hand threaded portions thereof; at least one bearing coupling the intermediate portion of the drive screw with the carriage to move the carriage along the base upon axial movement of the screw; a first nut threadingly receiving one threaded portion of the screw; a nut brake for selectively fixing the nut on the base so that screw rotation moves the screw axially to drive the carriage along the base; and a second nut fixed to the dresser and threadingly received by the other threaded portion of the drive screw on the opposite side of the bearing from the first nut so that the screw rotation moves the dresser relative to the carriage the same distance the carriage moves relative to the base and in the same direction, the dresser thereby moving twice as far as the carriage relative to the base for any given amount of screw rotation so a cutting tool held by the tool holder of the dresser dresses the grinding wheel in a precise manner that maintains the same cutting depth of the workpiece before and after dressing; a screw brake for selectively holding the screw against rotation; and a motor for rotating the first nut with the nut brake released and the screw brake holding the screw against rotation such that the screw is thereby moved axially without any relative movement between the dresser and the carriage.

20. A machine as in claim 19 which includes an annularly flanged journal bearing and an antifriction bearing that cooperatively couple the carriage to the intermediate portion of the drive screw between the right and left-hand threaded drive screw portions.

21. A machine as in claim 20 wherein the intermediate screw portion includes an annular flange that prevents axial movement of the journal bearing along the screw in one direction and also includes a threaded portion with a nut received thereby for holding the antifriction bearing against the journal bearing to prevent movement of the bearings with respect to the screw in the other direction.

22. A machine as in claim 19 further including a ratchet wheel rotatably fixed to the screw and also including a power unit for rotating the ratchet wheel with the nut brake holding the first nut against rotation and the screw brake released to permit screw rotation during a dress cycle.

23. A machine as in claim 22 wherein the power unit includes a cylinder having a reciprocal slide and a spring biased pawl carried by the slide for engagement with the ratchet wheel to provide rotation thereof during the dress cycle.

* * * * *

UNITED STATES PATENT OFFICE
CERTIFICATE OF CORRECTION

Patent No. 4,056,901 Dated November 8, 1977

Inventor(s) Marvin R. Anderson and Harald N. Jungesjo

It is certified that error appears in the above-identified patent and that said Letters Patent are hereby corrected as shown below:

Column 6, line 63, Delete "in the" second instance.

Column 10, line 62 "tooth" should be --tool--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*